US008096387B2

(12) United States Patent
Kattainen et al.

(10) Patent No.: US 8,096,387 B2
(45) **Date of Patent: *Jan. 17, 2012**

(54) FAIL-SAFE POWER CONTROL APPARATUS WITH CONTROLLABLE CHANGE-OVER SWITCHES

(75) Inventors: Ari Kattainen, Hyvinkaa (FI); Antti Kallioniemi, Jokela (FI)

(73) Assignee: Kone Corporation, Helsinki (FI)

( * ) Notice: Subject to any disclaimer, the term of this patent is extended or adjusted under 35 U.S.C. 154(b) by 216 days.

This patent is subject to a terminal disclaimer.

(21) Appl. No.: 12/572,800

(22) Filed: Oct. 2, 2009

(65) Prior Publication Data

US 2010/0032246 A1 Feb. 11, 2010

Related U.S. Application Data

(63) Continuation of application No. PCT/FI2008/000020, filed on Feb. 1, 2008.

(51) Int. Cl.
*B66B 1/28* (2006.01)

(52) U.S. Cl. ..... 187/248; 187/391

(58) Field of Classification Search ..... 187/247, 187/248, 289–297, 391–393; 318/268, 799–815
See application file for complete search history.

(56) References Cited

U.S. PATENT DOCUMENTS

| | | | | | |
|---|---|---|---|---|---|
| 3,902,573 | A * | 9/1975 | Grove et al. | ..... | 187/290 |
| 5,360,952 | A * | 11/1994 | Brajczewski et al. | ..... | 187/248 |
| 5,387,769 | A * | 2/1995 | Kupersmith et al. | ..... | 187/248 |
| 5,414,333 | A * | 5/1995 | Tanahashi | ..... | 318/268 |
| 5,698,823 | A * | 12/1997 | Tanahashi | ..... | 187/296 |
| 5,780,786 | A * | 7/1998 | Miyanishi | ..... | 187/293 |
| 5,893,432 | A * | 4/1999 | Nguyen et al. | ..... | 187/290 |
| 5,900,597 | A * | 5/1999 | Fernkas | ..... | 187/297 |
| 5,929,400 | A * | 7/1999 | Colby et al. | ..... | 187/393 |
| 6,050,368 | A * | 4/2000 | Pakarinen et al. | ..... | 187/293 |
| 6,264,005 | B1 * | 7/2001 | Kang et al. | ..... | 187/290 |
| 7,268,514 | B2 * | 9/2007 | DeLange et al. | ..... | 318/757 |
| 7,344,004 | B2 * | 3/2008 | Engel et al. | ..... | 187/391 |
| 7,482,771 | B2 * | 1/2009 | Hahn et al. | ..... | 318/272 |
| 7,506,726 | B2 * | 3/2009 | Andrejak et al. | ..... | 187/290 |
| 7,650,968 | B2 * | 1/2010 | Oesterle et al. | ..... | 187/290 |
| 2003/0150690 | A1 | 8/2003 | Wiesinger et al. | | |
| 2006/0060427 | A1 | 3/2006 | Chida | | |

* cited by examiner

*Primary Examiner* — Anthony Salata
(74) *Attorney, Agent, or Firm* — Birch Stewart Kolasch & Birch, LLP

(57) ABSTRACT

A fail-safe power control apparatus for supplying power between an energy source and the motor of a transport system. The power control apparatus includes a power supply circuit, which has at least one converter containing controllable change-over switches, and the power control apparatus has a controller for controlling the converter change-over switches, a data transfer bus, at least two controllers adapted to communicate with each other, and a control arrangement for controlling a first braking device, and possibly a control arrangement for controlling a second braking device.

20 Claims, 11 Drawing Sheets

FAIL-SAFE POWER CONTROL APPARATUS WITH CONTROLLABLE CHANGE-OVER SWITCHES

This application is a Continuation of copending PCT International Application No. PCT/FI2008/000020 filed on Feb. 1, 2008, which designated the United States, and on which priority is claimed under 35 U.S.C. §120. This application also claims priority under 35 U.S.C, §119(a) on Patent Application No. 20070206 filed in Finland on Apr. 3, 2007. The entire contents of each of the above documents is hereby incorporated by reference.

FIELD OF THE INVENTION

The present invention relates to a fail-safe power control apparatus for supplying power between an energy source and the motor of a transport system, said power control apparatus comprising a power supply circuit which comprises at least one electronic power converter containing controllable change-over switches, said power control apparatus further comprising at least a first and a second controller adapted to communicate with each other, said controllers comprising altogether at least one converter control function, and said power control apparatus comprising the control of at least one braking device.

PRIOR ART

Transport systems, such as elevator systems, are traditionally provided with a separate control system for controlling the transport system and a separate safety system for ensuring the safety of the transport system.

The control system of an elevator system comprises at least an elevator motor, an elevator controller and a power control apparatus for supplying power to the elevator motor. The elevator controller comprises an elevator group control function and functions for the handling of car calls and landing calls.

The safety system of an elevator system comprises a safety circuit, which comprises a series circuit of one or more safety contacts that open in a failure situation, and safety devices activated upon opening of the safety circuit, such as a machine brake or a car brake. Moreover, the safety system may comprise, among other things, an overspeed governor which, in the case of an overspeed, activates the safety gear of the elevator car, and terminal buffers at the ends of the elevator shaft.

During recent years, the safety regulations concerning transport systems have changed and it has become possible in terms of regulatory technology to replace various mechanical safety devices with corresponding electric safety devices.

Specification U.S. Pat. No. 6,170,614 discloses an electronic overspeed governor which can be used to replace a mechanical, centrifugally operated overspeed governor in an elevator system. The electronic overspeed governor measures the velocity or position of the elevator car and, upon concluding that an overspeed of the elevator car is occurring, activates a stopping device, such as a safety gear, of the elevator car to stop it.

Specification EP 1,159,218 discloses an electronically implemented safety circuit for an elevator system. The traditional elevator-system safety circuit with a series connection of safety contacts has been modified by using an arrangement whereby the state of the safety contacts or corresponding sensors is measured and transmitted by serial transfer to a separate controller. This modification of the safety circuit is approved in the new elevator-system safety standards concerning electric safety equipment, in the so-called PESSRAL standards.

Replacing separate mechanical safety devices, or safety devices implemented using mechanical switches, such as relays, with corresponding electronic safety devices does not essentially reduce the number of safety devices. The basic function of the safety devices is still based on measuring specific transport system parameters, such as the velocity or position of the transporting equipment, and inferring from the measured parameters whether a failure of the transporting equipment may have occurred. For example, if a dangerous failure occurs in a power control apparatus, such as an inverter controlling the motor of the transporting equipment, this failure is only detected after a delay e.g. by the overspeed governor when the speed of the transporting equipment has increased to a dangerous level exceeding the limit value of the highest allowed velocity.

Specification US 2003/0150690 A1 discloses a fail-safe control apparatus provided with two channels for monitoring the speed of a transport system and for stopping the system.

Specification US 2006/0060427 A1 discloses fail-safe control apparatus provided with two controllers for monitoring the speed of a transport system and for stopping the system.

OBJECT OF THE INVENTION

The object of the present invention is to disclose a failure-safe power control apparatus which is so arranged that a possible failure situation of the transport system can be detected substantially earlier than is possible when prior-art transport system safety systems are used. At the same time, it is an object of the invention to disclose an apparatus that will enable the safety system of a transport system to be made considerably simpler than prior-art safety systems. A safety system containing a fail-safe power control apparatus according to the invention contains fewer separate safety devices than prior-art safety systems do.

FEATURES OF THE INVENTION

One variation of the fail-safe power control apparatus of the invention may be characterized by a configuration where at least the first and the second controllers comprise inputs for motion signals of the transporting equipment, monitoring of the motion of the transporting equipment, and outputs for control signals for at least one braking device. Inventive embodiments are also presented in the description part of the present application. The inventive content disclosed in the application can also be defined in other ways than is done in the claims below. The inventive content may also consist of several separate inventions, especially if the invention is considered in the light of explicit or implicit sub-tasks or with respect to advantages or sets of advantages achieved. In this case, some of the attributes contained in the claims below may be superfluous from the point of view of separate inventive concepts.

The present invention concerns a fail-safe power control apparatus for a transport system. Fail-safe in this context refers to an apparatus which is so designed that failure takes place safely in such manner that the failure of the apparatus will in no circumstances cause a danger to the users of the transport system controlled by the power control apparatus.

The transport system concerned by the invention may be e.g. an elevator system, an escalator system, a moving walkway system or a crane system. The term 'transport system' here refers to the entire system intended for transportation, such as an elevator system, whereas the term 'transporting equipment' refers to a system component, such as an elevator car, used for actual transportation.

The power control apparatus of the invention for supplying power between an energy source and the motor of a transport system comprises a power supply circuit comprising at least one electronic power converter containing controllable change-over switches. The power control apparatus comprises at least a first and a second controller adapted to communicate with each other, which controllers comprise altogether at least one converter control function. The power control apparatus comprises the control of at least one braking device. At least the first and the second controllers comprise inputs for transporting-equipment motion signals, monitoring of the motion of the transporting equipment, and outputs for control signals for at least one braking device. 'Transporting equipment motion signal' refers to a signal indicating a motional state of the transporting equipment, such as acceleration, velocity or position of the transporting equipment. Such a signal may be e.g. the measurement signal of an encoder or acceleration sensor measuring the motion of the transporting equipment. Correspondingly, 'monitoring the motion of the transporting equipment' refers to monitoring of the motional state, such as acceleration, velocity or position, of the transporting equipment. 'Determination of a motion reference for the transporting equipment' means determining a reference value/set of reference values for the motional state, such as acceleration, velocity or position, of the transporting equipment.

In an embodiment of the invention, at least the first controller comprises inverter control, while at least the second controller comprises adjustment of the speed of the transporting equipment. In this case, the first and second controllers comprise inputs for measurement signals indicating transporting equipment velocity and/or position, as well as monitoring of the velocity and/or position of the transporting equipment.

In a power control apparatus according to the invention, the first and second controllers contain safety diagnostics. 'Safety diagnostics' refers to monitoring or control designed according to a specific safety procedure, such as a computer program, and/or control electronics designed in accordance with a safety procedure.

In an embodiment of the invention, a failure situation of the aforesaid safety diagnostics is determined on the basis of motion monitoring of the transporting equipment.

In an embodiment of the invention, a failure situation of the aforesaid safety diagnostics is determined on the basis of the communication between the first and the second controllers.

In a power control apparatus according to the invention, at least the first and the second controllers comprise outputs for control signals for a first and a second braking device. In this case, the first braking device may be a machine brake mechanically engaging the axle or drive sheave of the motor of the transporting equipment. The second braking device may also be a machine brake engaging the said motor, or e.g. a brake which is mechanically engaged between the elevator car and a guide rail of the elevator car, such as a rail brake or an overspeed-governor wedge brake.

In a power control apparatus according to the invention, a communication bus is arranged between the first and the second controllers. The second controller is adapted to send to the first controller a message at predetermined time intervals, and the first controller is adapted to send upon receiving the message a reply message to the second controller within a predetermined period of time. Upon detecting a deviation of the interval between messages or reply messages from the predetermined limit values, both controllers are adapted to perform independently of each other an action to stop the transport system.

In a power control apparatus according to the invention, both the message and the reply message contain at least the following data items: velocity and/or position measurement data read by the controller sending a message or reply message; notification regarding a fault detected by the controller sending a message or reply message; and a control command to at least one braking device. Upon detecting a deviation between the control commands to a braking device or between the velocity and/or position measurement data of the controllers, or upon receiving a message regarding a fault detected, both controllers are adapted to perform an action independently of each other to stop the transport system.

A power control apparatus according to the invention comprises interruption of the power supply circuit, in which case at least the first and the second controllers comprise an output for a control signal for interrupting the power supply circuit.

A power control apparatus according to the invention comprises control means for controlling the change-over switches of the converter, said control means comprising a power source at least for control energy controlling the positive or negative change-over contacts. In this case, the interruption of the power supply circuit comprises two controllable switches fitted in series with the power source for interrupting the supply of control energy, and the first controller is adapted to control the first switch and the second controller is adapted to control the second switch to interrupt the supply of control energy.

In an embodiment of the invention, the control of at least one braking device comprises two switches fitted in series in a brake control circuit, the first controller comprises an output for the control signal of the first switch and the second controller comprises an output for the control signal of the second switch, and both the first and the second controllers comprise inputs for data indicating the positions of the first and the second switches.

In a power control apparatus according to the invention, the first controller comprises an output for a first pulse-shaped control signal and the second controller comprises an output for a second pulse-shaped control signal. The first controller comprises an input for the measurement of the second pulse-shaped control signal, and the second controller comprises an input for the measurement of the first pulse-shaped control signal. In this embodiment of the invention, the control of at least one braking device comprises an input for the first and second pulse-shaped control signals, and the control of the said braking device is adapted to supply control power to the braking device only via simultaneous control by the first and the second pulse-shaped control signals.

A power control apparatus according to the invention comprises a data transfer bus, which comprises at least a first data bus, in which the first controller is adapted to communicate. Another power control apparatus according to the invention comprises, in addition to the first data bus, a second data bus, in which the second controller is adapted to communicate. In this case, the power control apparatus further comprises a transmitter connected to the first data bus for the transmission of a first motion signal of the transporting equipment and a transmitter connected to the second data bus for the transmission of a second motion signal of the transporting equipment. In this embodiment of the invention, the first and the second controllers are adapted to compare the first and the second motion signals read by them parallelly from the data buses and, upon detecting that the signals differ from each other by more than a certain limit value, to perform an action to stop the transport system. The aforesaid first and second data buses may be wired or wireless buses. In wireless data buses, data can be transferred in the form of e.g. an electromagnetic signal or an ultrasound signal.

In an embodiment of the invention, the data transfer bus comprises a transmitter connected to the first data bus for the transmission of status data of a safety contact of the transport system and a transmitter connected to the second data bus for the transmission of status data of a safety contact of the transport system.

In a power control apparatus according to the invention, the converter control comprises a motor driving mode, and at least the first controller is adapted to switch alternatively the positive or the negative change-over contacts of the converter to a conducting state for dynamic braking of the motor in a situation where the state of the converter control differs from the motor driving mode.

In a power control apparatus according to the invention, the monitoring of the velocity and/or position of the transporting equipment comprises in connection with the first controller an envelope curve of a first maximum allowed velocity and in connection with the second controller an envelope curve of a second maximum allowed velocity. In this case, the first and the second controllers are adapted to compare the measured velocity with the value of the corresponding envelope curve of the maximum allowed velocity and, upon detecting a difference exceeding a predetermined limit value between the measured velocity and the envelope curve value, to perform an action to stop the transport system.

In an embodiment of the invention, the second controller, upon detecting a difference exceeding a predetermined limit value between the measured velocity and the value of the envelope curve of the maximum allowed velocity, is adapted to send to the first controller a motor-torque set value to stop the transport system with predetermined deceleration.

A power control apparatus according to the invention is adapted, upon detecting a difference exceeding a predetermined limit value between the measured velocity and the value of the envelope curve of the maximum allowed velocity, to stop the motor by converter control with predetermined deceleration.

In a power control apparatus according to the invention, the first controller comprises mains converter control.

In a power control apparatus according to the invention, at least the first controller is adapted, upon detecting a failure situation, to interrupt by mains converter control the supply of power from the energy source to the direct-voltage intermediate circuit of the power supply circuit.

A power control apparatus according to the invention is adapted to supply power between an energy source and the motor of an elevator system.

Using the power control apparatus of the invention, power can be supplied between any energy source and any transport system motor. The motor may be an electric motor of any type, either a rotating or a linear motor. The energy source may be e.g. a mains supply or an electricity generator. The energy source may also be a direct voltage source, such as a battery or super-capacitor.

The power supply circuit of the power control apparatus of the invention comprises at least one converter which comprises controllable switches and which may be e.g. an inverter supplying a voltage of varying frequency and amplitude to a motor. The power supply circuit may also comprise other converters, such as a mains converter. In this case, the mains converter converts the alternating voltage of a mains supply into a direct voltage to the direct-voltage intermediate circuit of the power supply circuit, and an inverter again converts the voltage of the direct-voltage intermediate circuit into an alternating voltage for the motor.

In an embodiment of the invention, a communication bus is provided between the first and the second controllers. The second one of the controllers is adapted to send to the first controller at predetermined time intervals a message, whose length and content may be predetermined. The first one of the controllers is adapted to send a reply message to the second controller within a given predetermined period of time. If the first controller detects that no message arrives from the second controller within the predetermined time interval, then it concludes that the second controller has failed. Similarly, if the second controller detects that the first controller does not send a reply message within the predetermined period of time, it concludes that the first controller has failed. In such a case, the controller having detected a failure situation is able to perform an action to stop the transport system on its own accord, independently of the other controller, which it has concluded to have failed. An 'action to stop the transport system' refers to stopping the transport system in a controlled manner with predetermined acceleration or stopping the transport system by actuating at least one stopping device, such as a machine brake or a braking device of an elevator car. The action to stop the transport system may also comprise an action to prevent restarting of the transport system, e.g. by setting at least the first or the second controller into an operating state where release of the brake and/or starting of the motor is inhibited. The time interval between successive messages to be transmitted and the allowed time delay of the reply message are typically so short that a failure of a controller can be detected essentially before this could cause a danger situation in the transport system. The time interval between successive messages may be e.g. 10 milliseconds.

In an embodiment of the invention, the change-over switches used in the converter are IGBT transistors. In this case, 'means for controlling the change-over switches of the converter' refers to signal paths for the control signals controlling the change-over switches and to means for amplifying the control signals. These means comprise at least a power source for control energy for the gate controllers of the IGBT transistors and an amplifier circuit for amplifying the control signals to the gate of the IGBT transistor. The change-over switches used may also be controllable switches other than IGBT transistors, e.g. prior-art MOSFET transistors or GTO thyristors. In this case, too, the control means may comprise a signal path, a power source for control energy for controlling the switches and an amplifier circuit for amplifying the control signals.

In an embodiment of the invention, the power control apparatus comprises a function for interrupting the power supply circuit. In an embodiment of the invention, the interruption of the power supply circuit is implemented by inhibiting the supply of power to the amplifier circuit comprised in the means for controlling the change-over switches. This supply of power is inhibited by means of two controllable switches connected mutually in series, which are in series with the power source supplying power to the amplifier circuit. The first one of these switches is controlled by the first controller and the second one by the second controller. It is thus possible to interrupt the power supply circuit by either one of the controllers independently the other one. In addition, the state of the control signal of the second switch can be measured by the first controller and the state of the first switch by the second controller, and so the operating state of the power-supply-circuit interruption function can be verified for correctness via crosswise measurement. The controllable switches used for the interruption may preferably be MOSFET transistors.

In an embodiment of the invention, the power control apparatus comprises a brake control circuit and two controllable switches fitted in series with each other in the brake control circuit. When at least one of the these switches is open, the brake control circuit is in an interrupted state and no current is flowing to the brake coil. The brake is thus engaged, preventing movement of the transporting equipment. In this embodiment of the invention, the first switch is controlled by the first controller and the second switch by the second controller, and thus the brake control circuit can be interrupted by either controller independently of each other.

The apparatus of the invention may also comprise one or more control functions for controlling a braking device, which comprise an input for a first and a second pulse-shaped control signal. The first controller may supply a first pulse-shaped control signal and the second controller a second pulse-shaped control signal to each one of the aforesaid braking device control functions. Each braking device control function is adapted to supply power to the braking device only upon receiving both the first and the second pulse-shaped control signals. If either one of the pulse-shaped control signals ceases, i.e. if the control signal changes into a DC signal, then the control function controlling the braking device immediately stops supplying power to the braking device. The braking device now starts braking, thus preventing movement of the transporting equipment.

In an embodiment of the invention, the power control apparatus comprises a data transfer bus consisting of two separate data buses. The first controller is adapted to communicate over the first data bus and the second controller is adapted to communicate over the second data bus. The controllers are able to read data simultaneously from the separate data buses of the data transfer bus, to send the data they have read to each other via the communication bus between the controllers, to compare the simultaneously read data items to each other and thus to verify the correctness of the data. For example, there may be fitted to the first data bus a first measuring unit, which measures the acceleration, velocity or position of the transporting equipment and sends via its transmitter the measured data regarding the acceleration, velocity or position of the transporting equipment over the first data bus to the first controller. Fitted to the second data bus there may be a second measuring unit, which measures the acceleration, velocity or position of the transporting equipment and sends via its transmitter the measured data regarding the acceleration, velocity or position of the transporting equipment over the second data bus to the second controller. The controllers can perform a mutual comparison between the measurement data of the first and the second measuring units and, upon detecting between the measurement data a difference exceeding a maximum allowed limit value, conclude that one of the measuring units has failed. In this case, the power control apparatus can perform an action to stop the transport system and prevent restarting of operation, e.g. by stopping the transporting equipment with predetermined acceleration and/or by actuating at least one stopping device.

In an embodiment of the invention, the power control apparatus is adapted to read the status of at least one safety switch of the transporting equipment. Fitted in conjunction with the safety switch is an electronic reading unit, which reads the status of the safety switch and transmits it separately into the first and the second data buses. The first and the second controllers read the status of the safety switch and compare the status data to each other. In this way, by comparing the status data, it is possible to verify the correctness of the safety switch status data. Safety switches like these include e.g. landing-door safety switches in an elevator system and comb-plate safety switches in an escalator system.

At least the first controller in the power control apparatus according to the invention comprises a converter control stage. The converter control may comprise different operating modes, such as a motor driving mode, which means a mode wherein at least the first controller adjusts the torque of the motor of the transport system according to the speed reference as far as possible. The converter control may also comprise a dynamic braking mode, and the converter control may be adapted to enter the dynamic braking mode each time upon exiting the motor driving mode. In the dynamic braking mode, at least the first controller can control alternatively the positive or the negative change-over contacts of the converter to the conducting state, thus activating prior-art dynamic braking of the motor.

In this context, 'change-over switch' refers to two controllable switches fitted in series between the positive and negative current rails of the direct-voltage intermediate circuit in the power supply circuit. 'Positive change-over contact' means the one of the switches which is fitted to the positive current rail and 'negative change-over contact' means the switch fitted to the negative current rail.

In an embodiment of the invention, the first and the second controllers comprise envelope curves for the maximum allowed velocity. The values of the envelope curve of the maximum allowed velocity may vary as a function of position of the transporting equipment, e.g. in such manner that the limit values are smaller in absolute value when the transporting equipment is approaching the end limits of movement. Further, the limit values may vary according to the desired velocity of the transporting equipment, i.e. according to the speed reference, in such manner that the limit values are always higher in absolute value than the absolute value of the speed reference, according to either a predetermined constant value or a scaling factor greater than unity. In an embodiment of the invention, the first and the second controllers make separate comparisons between the velocity of the transporting equipment and the value of the envelope curve of the maximum allowed velocity. If the first or the second controller detects that the measured velocity of the transporting equipment differs by more than a predetermined limit value, they can perform an action to stop the transport system independently of each other.

The controllers mentioned in the invention may be e.g. microcontrollers or programmable FPGA (field programmable gate array) circuits. The controllers may also be implemented using discrete components, such as logic circuits.

ADVANTAGES OF THE INVENTION

The advantages achieved by the invention include at least one of the following:

- the number of separate safety devices is reduced, the overall system being thus simplified. The reliability of the overall system is improved and the costs are reduced.
- as the stopping devices are not directly controlled by mechanical switches but the switch statuses are measured and the measurement data may be filtered, system reliability problems due to transient interruptions of the switches are reduced.
- as the power control apparatus takes care of safe stopping of the elevator in a centralized manner, the apparatus can, based on the inference it has made, bring the elevator car to a standstill with a predetermined deceleration and e.g. park the elevator car at the nearest floor, thus letting the passengers to leave the elevator car, or, if the situation so requires, the power control apparatus can actuate at least one stopping device to stop the elevator car as quickly as possible.

the controllers included in the power control apparatus can monitor each other's operation and, upon detecting a failure situation, control the elevator car so as to bring it immediately to a standstill, the reaction time of the system in the case of a failure of the power control apparatus being thus shortened.

when the motor is to be controlled by the power control apparatus, the controllers need to calculate a set value, i.e. a motion reference, for the elevator car movement as a function of distance or time. When the extreme limits of allowed movement are to be monitored, forming the extreme limits from this motion reference does not require much calculation. For example, the envelope curve of the maximum allowed velocity used in overspeed control can be easily generated from the set value of velocity as a function of distance or time, i.e. from the speed reference, e.g. via linear scaling in a prior-art manner, so the calculation of the envelope curve can be performed faster, which again saves calculation capacity of the controllers.

BRIEF DESCRIPTION OF DRAWINGS

In the following, the invention will be described in detail by referring to the attached drawings, wherein.

EMBODIMENT EXAMPLES

The following example is a description of an elevator system provided with a fail-safe power control apparatus.

Figure 1:
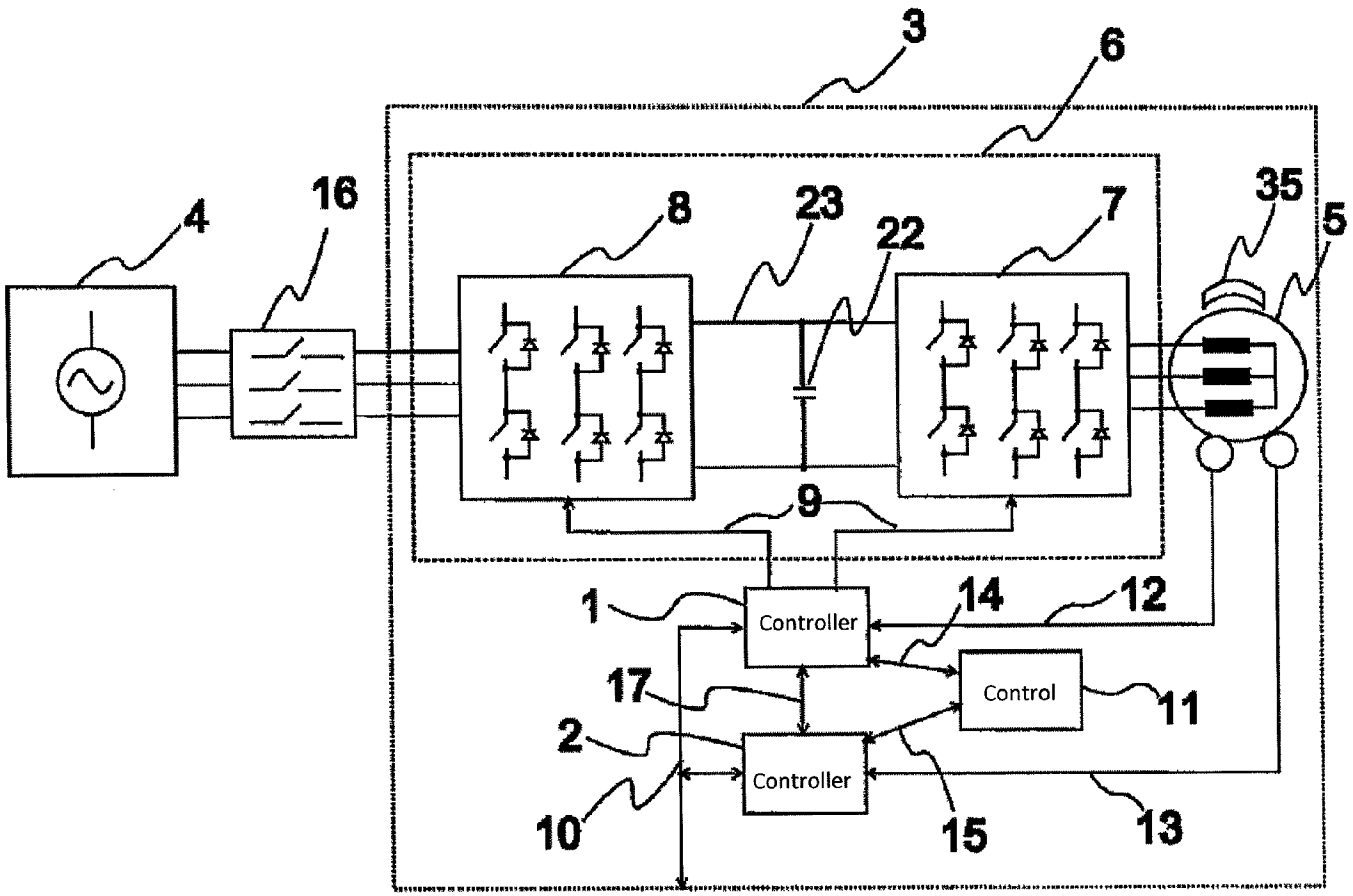
FIG. 1 represents a power control apparatus according to the invention

FIG. 1 represents a fail-safe power control apparatus according to the invention. The power supply circuit 6 comprises a mains converter 8 and an inverter 7. The mains converter converts a sinusoidal mains voltage 4 into a direct voltage, which is passed to the direct-voltage intermediate circuit 23 of the power supply circuit. The direct-voltage intermediate circuit comprises an energy storage 22 for smoothing the voltage. The inverter 7 converts the direct voltage into a variable-frequency and variable-amplitude voltage for feeding a motor 5. The mains supply is additionally provided with a main switch 16.

A second controller 2 measures the motor speed 13 and adjusts the measured speed according to a speed reference 59 as far as possible by transmitting via a communication bus 17 a motor-torque set value corresponding to the difference between the speed reference and the velocity measurement to a first controller 1. The first controller 1 adjusts the motor torque via its converter control function by controlling the change-over switches 32 of the inverter 7.

The second controller 2 sends the velocity value it has measured to the first controller 1 as a message via the communication bus 17. The first controller likewise measures the velocity 12 and sends the velocity value thus obtained as a reply message to the second controller via the communication bus. Both controllers compare the velocity measurements to each other and, upon detecting a difference exceeding a predetermined limit value between the measurements, perform an action to bring the elevator system to a safe state independently of each other. An 'action to bring the elevator system to a safe state' here means stopping the elevator car with a predetermined acceleration or by actuating at least one braking device. The first and the second controllers independently calculate an envelope curve 58 of the maximum allowed velocity. This is accomplished by scaling the set value of velocity, i.e. the velocity reference of the elevator car by a constant value greater than unity. In addition, the first and the second controllers compare the measured velocity values 12, 13 to the envelope curve of the maximum allowed velocity and, if the velocity measurement exceeds the value of the envelope curve, then the controllers perform independently of each other an action to bring the elevator system to a safe state.

In this embodiment of the invention, the velocity of the elevator car is measured by two encoders engaging the traction sheave of the elevator motor 5, but the measurement of elevator movement can also be arranged e.g. in such manner that the first controller 1 measures the motion of the elevator car e.g. by means of an acceleration sensor or encoder attached to the elevator car while the second controller 2 measures the motion of the motor 5 by means of an encoder coupled to the rotating axle or traction sheave. It is thus possible to detect via comparison of the measurements of elevator car movement e.g. the occurrence of an elevator rope breakage. However, it is also possible for both the first 1 and the second 2 controller to measure the elevator car movement, e.g. by means of sensors connected directly to the elevator car or to a rope pulley of the elevator overspeed governor.

To bring the elevator system to a safe state, either one of the controllers can actuate at least one braking device 44, 45 independently of each other. The control of the braking devices is so arranged that, for the brake to be released, a congruent control command is required from each controller. If no control command is obtained from either one of the controllers, then the brake is not released.

If bringing the elevator system to a safe state does not require immediate closing of the brake, then the second controller may send to the first controller a set value of the torque of the elevator motor to stop the elevator car with a predetermined deceleration 60. The first controller can also stop the elevator car with a predetermined deceleration independently of the second controller by controlling the motor torque via converter control.

The fail-safe power control apparatus also comprises a data transfer bus 10. Via the data transfer bus, the first 1 and the second 2 controllers can read sensors, such as the positions of safety switches 57, in the elevator system. The first and second controllers can compare the said position data and thus verify the operating condition of the measurements. Based on the measurements, the first and/or the second controller can perform an action to bring the elevator system to a safe state when necessary.

The first 1 and the second 2 controllers can independently interrupt the power supply circuit 6 by inhibiting the control of the negative 34 and/or positive 33 change-over contacts of the change-over switches of the inverter 7. In addition, the second controller can prevent the mains inverter 8 from supplying power from the mains supply 4 to the direct-voltage intermediate circuit 23 by sending an inhibition command to the first controller. The first controller can inhibit the supply of power from the mains to the direct-voltage intermediate circuit by controlling the mains inverter 8 via mains inverter control in such manner that no power flows into the direct-voltage intermediate circuit 23.

The mains inverter 8 may be a thyristor bridge, in which case the first and second controllers can interrupt the supply of power from the mains 4 to the direct-voltage intermediate circuit 23 by preventing the flow of current to the gates of the thyristors in the thyristor bridge.

Figure 2:
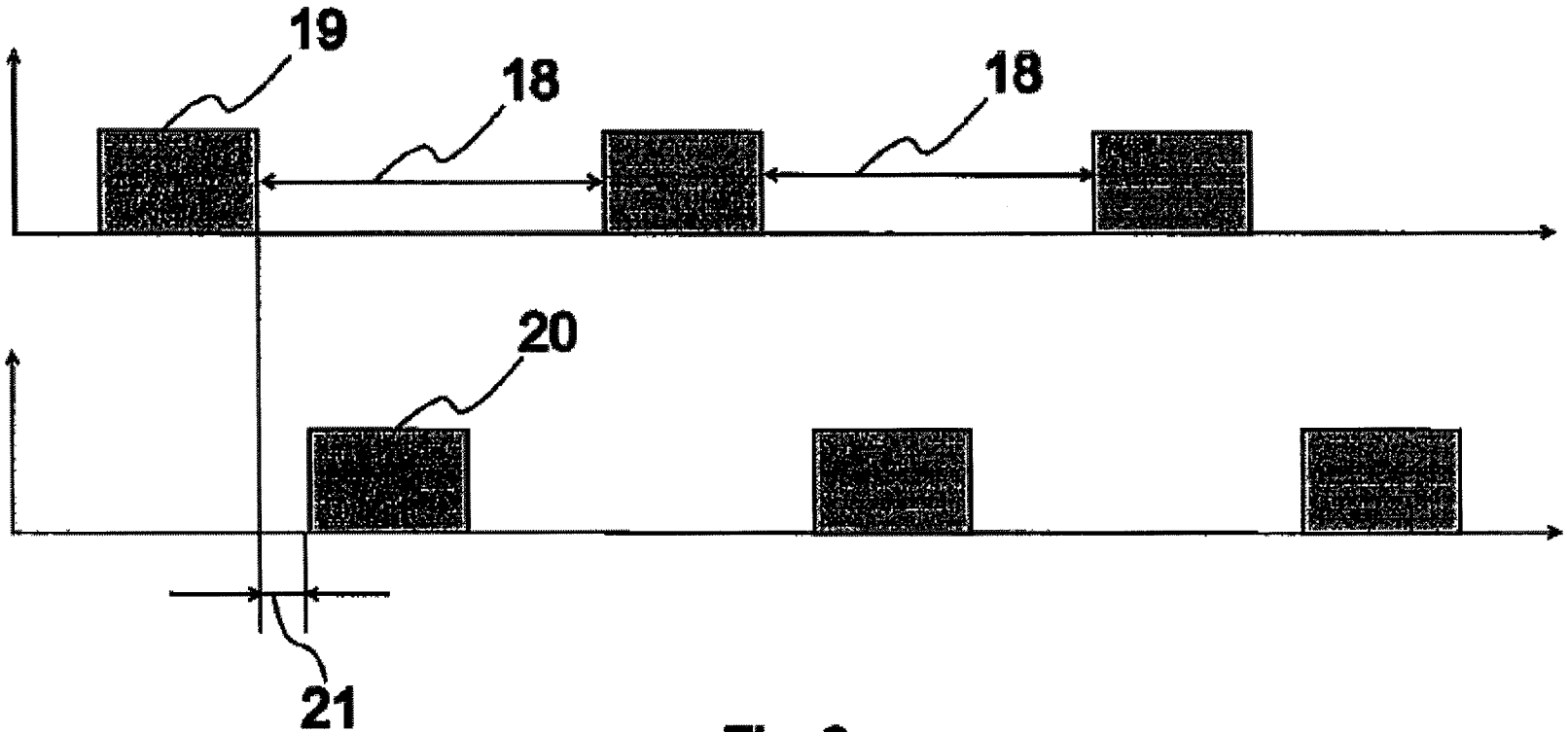
FIG. 2 illustrates the timing of messages transmitted over the communication bus of the power control apparatus of the invention
Figure 3:
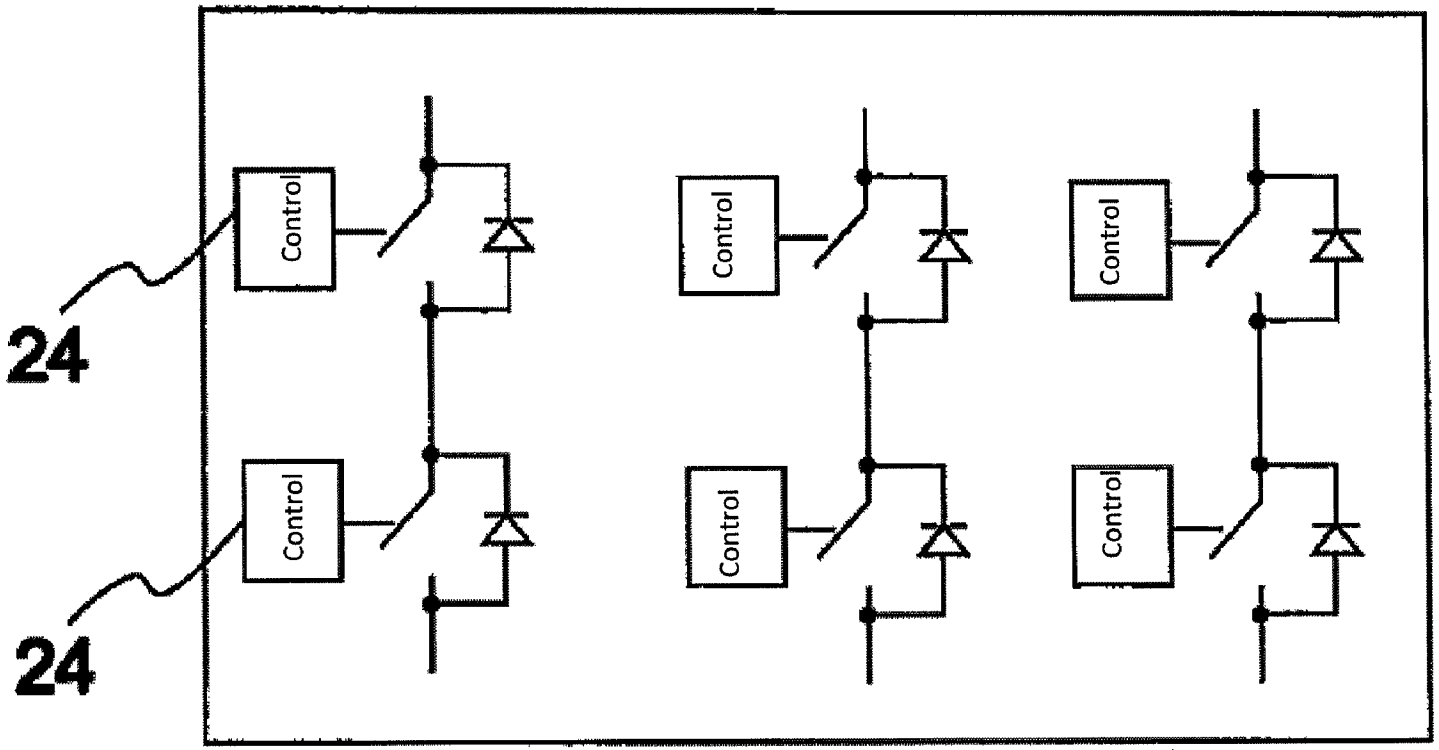
FIG. 3 represents a converter used in the power control apparatus of the invention

FIG. 2 visualizes the timing of the messages in the communication bus 17 between the first 1 and the second 2 controllers. The second controller 2 sends a message 19 to the first controller. The message is transmitted at regular intervals 18. The first controller 1 sends a reply message 20 to the second controller 2 within a predetermined period of time 21 after receiving the message 19. If the first controller detects that no message 19 arrives from the second controller at predetermined regular intervals 18, the first controller can infer that the second controller has failed and perform an action to bring the elevator system to a safe state. Similarly, if the second controller detects that the first controller does not send a reply message 20 within the predetermined period of time 21, the second controller can infer that the first controller has failed and perform an action to bring the elevator system to a safe state.

Figure 4:
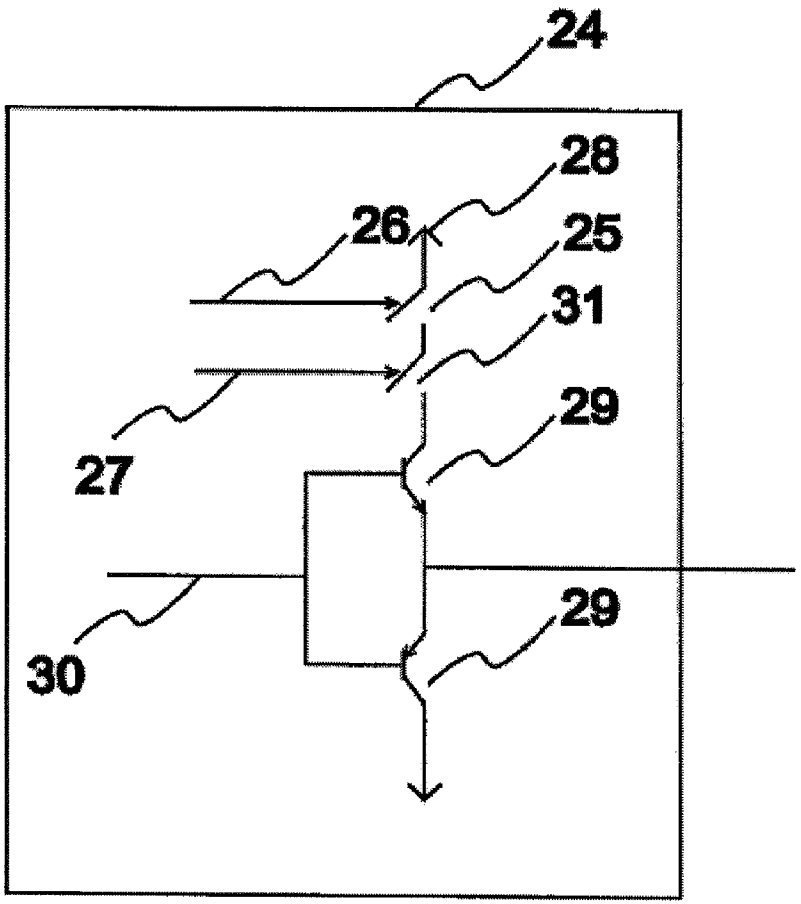
FIG. 4 illustrates interruption of a power supply circuit according to the invention
Figure 5:
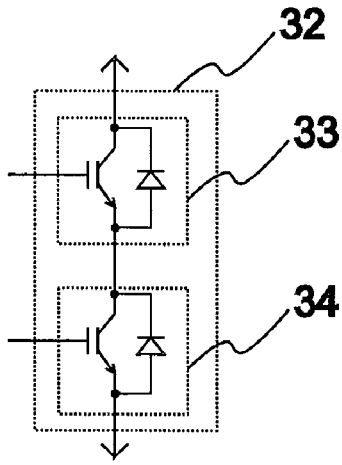
FIG. 5 represents a change-over switch in a power supply circuit according to the invention.

FIG. 4 represents the interruption of the power supply circuit 6. The interruption circuit comprises two controllable switches 25, 31, which can be used to prevent the supply of power to the amplifier circuit 29 amplifying the control signals 30 of the change-over contacts. The first controller controls switch 25 by means of control signal 26, and the second controller controls switch 31 by means of control signal 27. Since the switches 25, 31 are in series, both the first 1 and the second 2 controller can independently interrupt the power supply circuit 6 by opening the switch and thus preventing the supply of power to the amplifier circuit 29.

Figure 6:
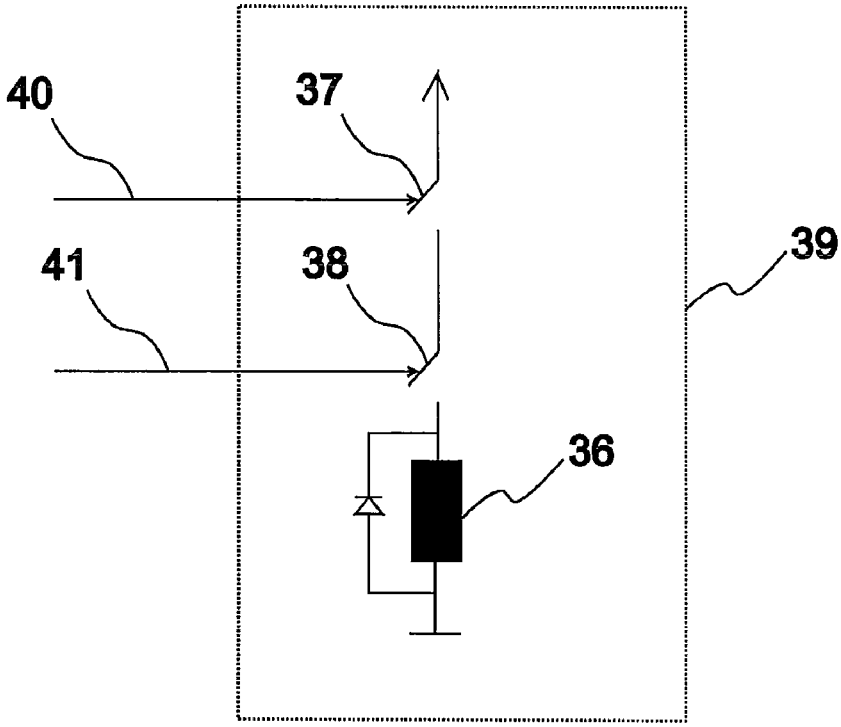
FIG. 6 illustrates a technique according to the invention for controlling a braking device

FIG. 6 illustrates the control of a braking device. The braking device is controlled by supplying a magnetizing current to a magnetizing coil 36 of the braking device 36. The brake is released when current is flowing in the coil. The brake control circuit 39 contains two controllable switches 37, 38 arranged in series. When either one of the switches is opened, the flow of current to the magnetizing coil is interrupted, thus preventing release of the brake. The first controller 1 controls the first switch 37 by means of control signal 40, and the second controller 2 controls the second switch 38 by means of control signal 41. Each controller can independently open the brake control circuit and thus prevent release of the brake. In other words, for the brake to be released, congruent control is required from both controllers 1, 2.

Figure 7:
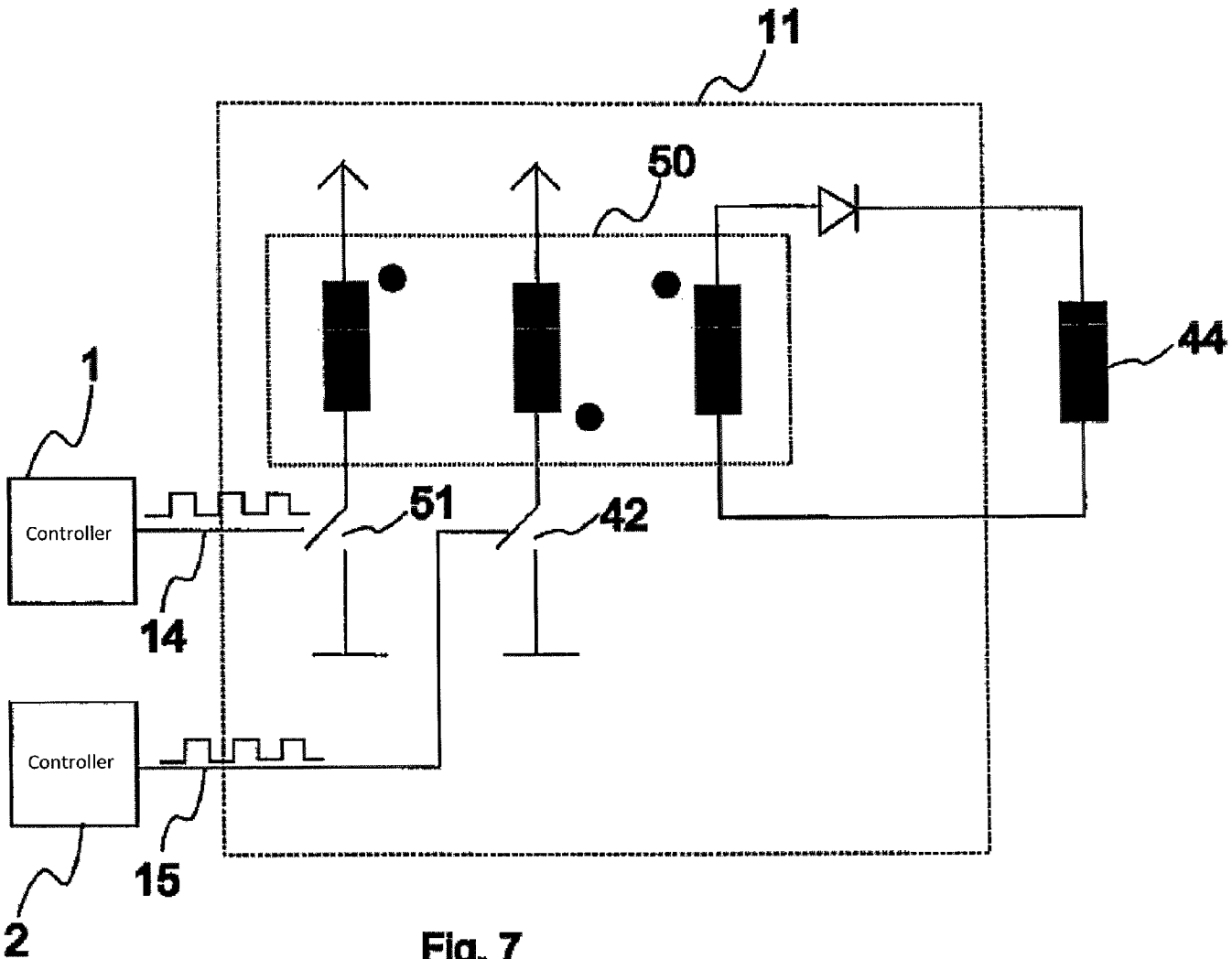
FIG. 7 illustrates another technique according to the invention for controlling a braking device

FIG. 7 represents a brake control arrangement 11. The brake control arrangement comprises a transformer 50 with two magnetizing coils on the primary side and one output coil on the secondary side. The currents in the magnetizing coils is controlled by alternately switching the switches 51, 42 controlled by a pulse-shaped control signal, the first switch 51 being controlled by the first controller 1 and the second controllable switch 42 by the second controller 2. For the output coil to feed power to the magnetizing coil 44 of the braking device, the transformer 50 must be alternately magnetized and demagnetized by the magnetizing coils. For this reason, the pulse-shaped control signals 14, 15 from the first and second controllers must be in opposite phase so that the switches 51 and 42 are alternately turned on and off. If either one of the controllers starts producing a DC signal instead of a pulse-shaped control signal, thereby ceasing to control the magnetization, then the supply of power to the magnetizing coil 44 of the braking device ceases and the brake is engaged.

Figure 8:
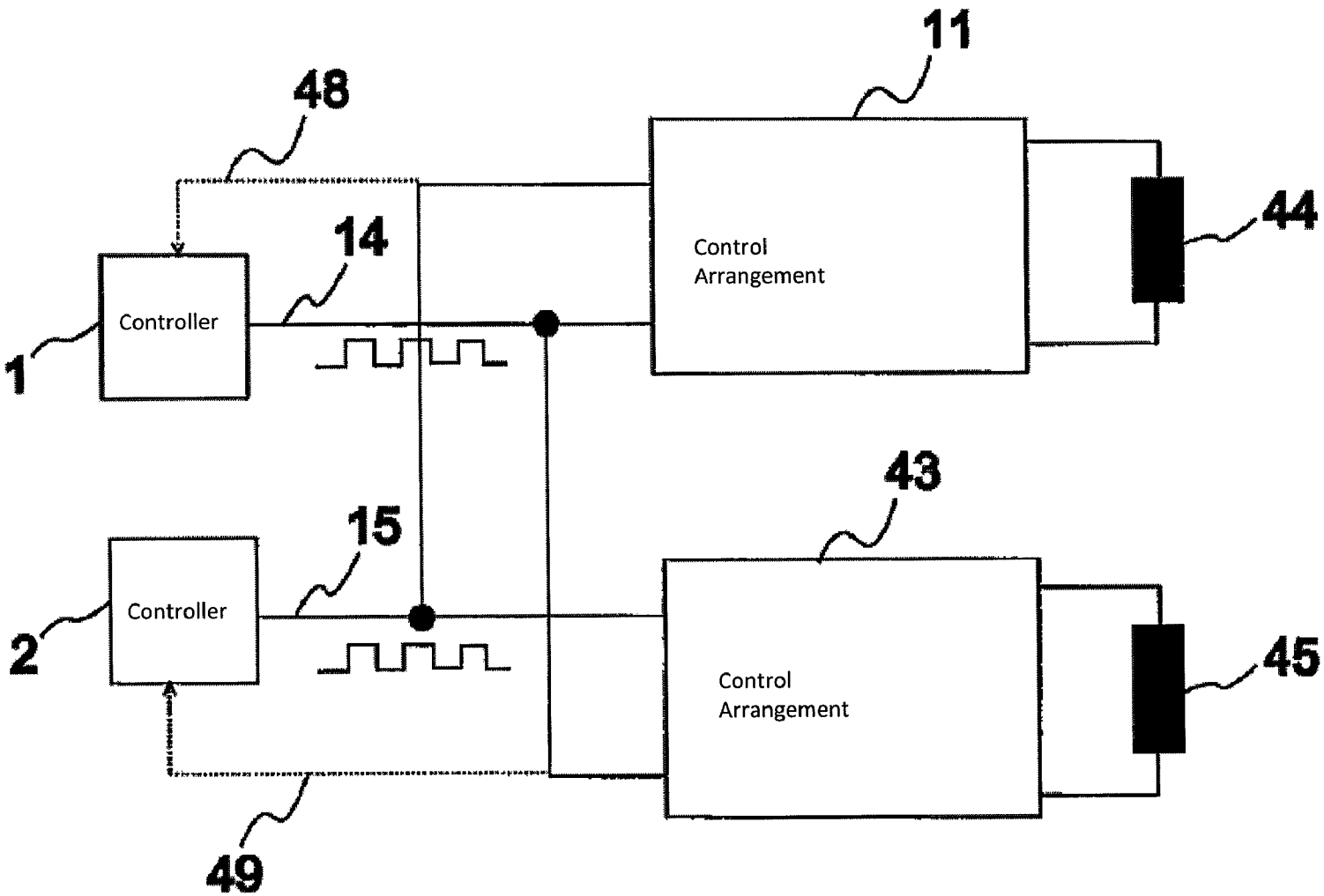
FIG. 8 illustrates a technique for controlling two braking devices according to the invention

FIG. 8 illustrates control arrangements 11, 43 used to control the magnetizing coils of a first 44 and a second 45 braking device. The first 1 and the second 2 controllers control the first 11 and the second 43 brake control arrangements simultaneously in such manner that, for power to be supplied to the magnetizing coils 44, 45 of the braking devices, the first and second controllers are required to produce a pulse-shaped control signal 14, 15. In addition, the first controller 1 has an input 48 for the measurement of the pulse-shaped control signal produced by the second controller 2, and the second controller 2 has an input 49 for the measurement of the control signal produced by the first controller. In this way, the controllers can measure the operating state of the brake control and verify the operating reliability.

Figure 9:
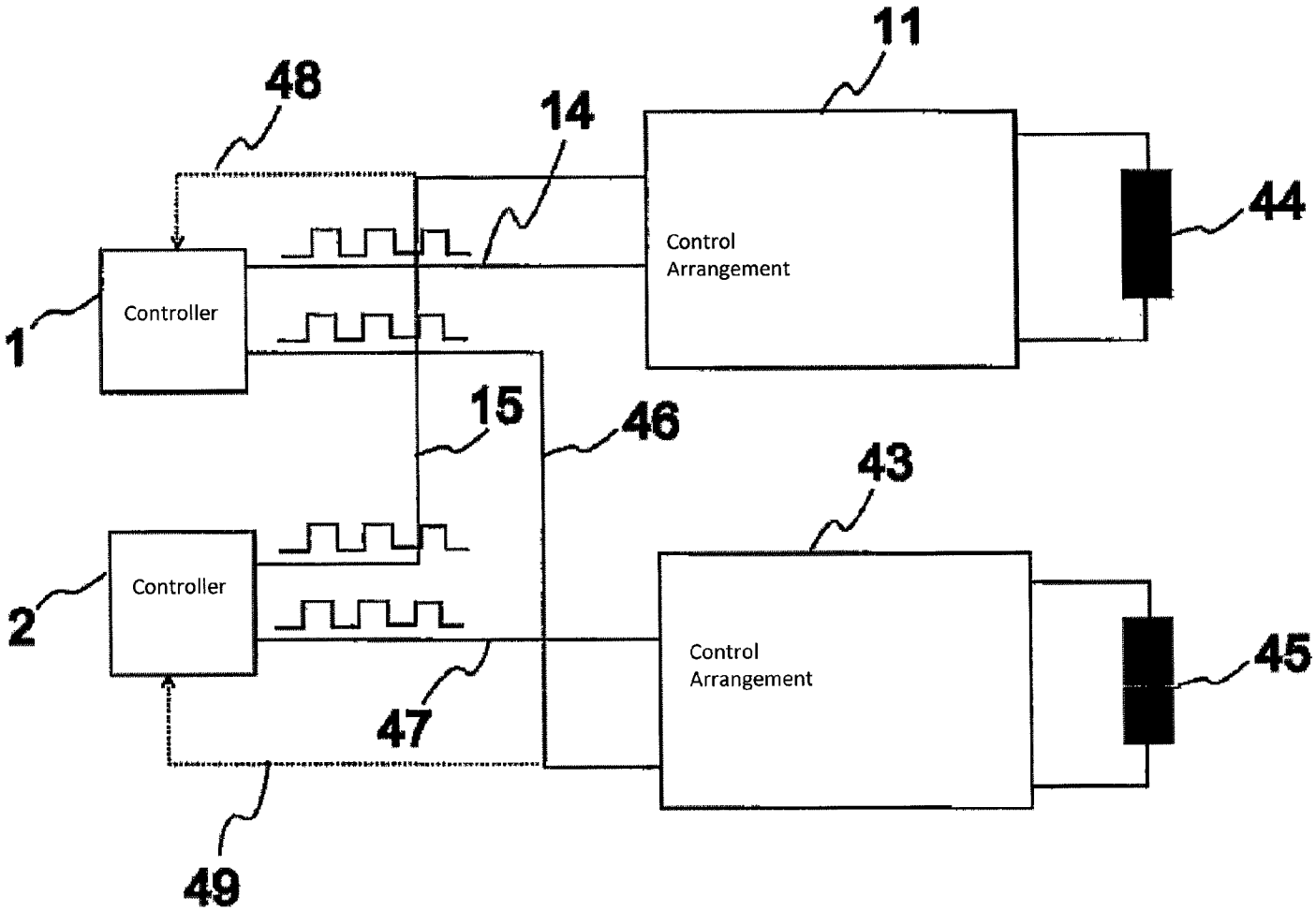
FIG. 9 illustrates another technique for controlling two braking devices according to the invention

FIG. 9 illustrates the control of the magnetizing coils 44, 45 of the braking devices. The first controller 1 has outputs for a control signal 14 for the first brake control arrangement 11 and for a control signal 46 for the second brake control arrangement 43. The second controller 2 has outputs for a control signal 15 for the first brake control arrangement 11 and for a control signal 47 for the second brake control arrangement 43. In this embodiment, the first and second magnetizing coils 44, 45 can be controlled independently of each other by pulse-shaped control signals.

Figure 10:
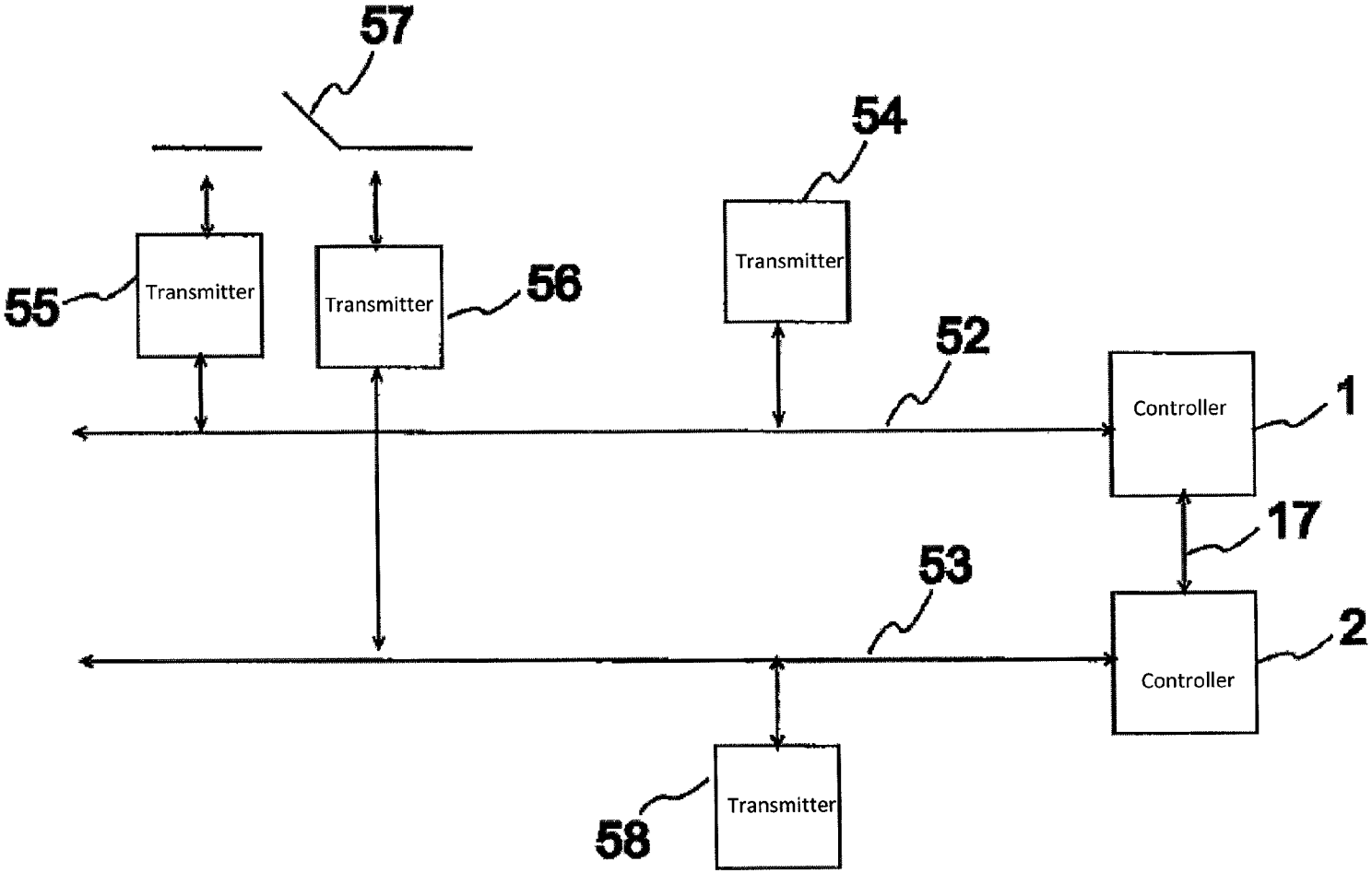
FIG. 10 represents a data transfer bus according to the invention
Figure 11:
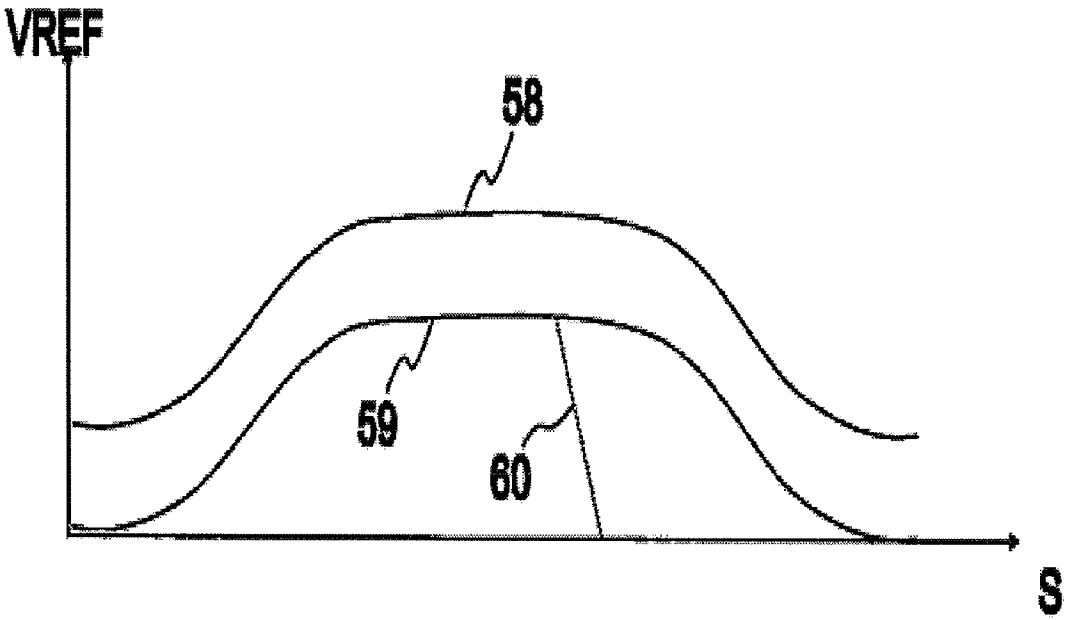
FIG. 11 represents an envelope curve according to the invention for the maximum allowed velocity of the transporting equipment and a velocity reference

FIG. 10 represents the data transfer bus 10 of the power control apparatus. The data transfer bus comprises a first data bus 52, over which the first controller 1 is fitted to communicate, and a second data bus 53, over which the second controller 2 is fitted to communicate. Connected to the data transfer bus are transmitters, such as a transmitter 54 for transmitting a first measurement 12 of elevator car velocity into the first data bus 52 and a transmitter 58 for transmitting a second measurement 13 of elevator car velocity into the second data bus 53. In addition, there may be connected to the data transfer bus e.g. transmitters 55, 56 for transmitting position data indicating the positions of safety switches in the elevator system into the first and second data buses. Examples of such safety switches of the elevator system are the landing-door safety switches.

Figure 12:
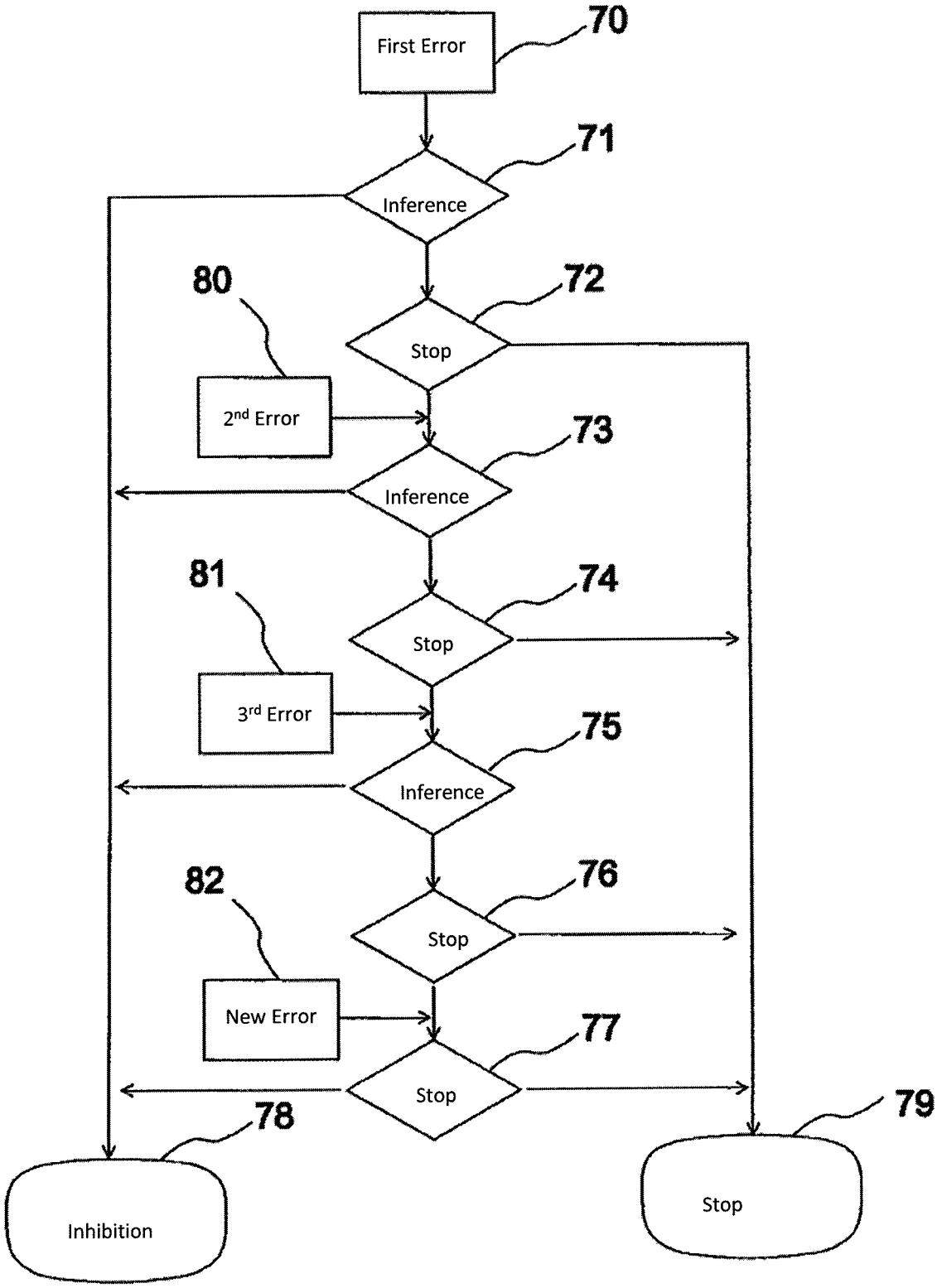
FIG. 12 illustrates the operation of the safety diagnostics.

FIG. 12 illustrates the operation of the safety diagnostics of the controller. The controller 1,2 determines a first error situation 70, such as a failure signal or functional deviation. The controller 1,2 then makes an inference 71 as to whether the error situation involves a hazard. If necessary, the controller sets the program execution into operation inhibition mode 78, in which case an action for stopping the transport system is carried out and in addition restarting of the transport system is inhibited. If the error situation does not require a transition into operation inhibition mode 78, the controller can still either stop the transport system 72, in which case the program execution enters a stopped state 79 where restarting of the transport system is allowed, or it can allow the transport system to continue operating in the normal manner. If the controller subsequently detects a second error situation 80, it again performs an inference in a corresponding manner to determine whether the error situation involves a hazard 73, 74, whereupon the controller either sets the transport system into operation inhibition mode 78, performs normal stopping 79 of the transport system, or allows normal operation of the transport system. After a third error situation 81, a similar inference procedure 75, 76 is repeated once more, and if after this a new error situation 82 follows, the transport system is stopped and the program execution is set either into an operation inhibition mode 78 as defined in the safety diagnostics software or into a stopped mode 79 permitting restarting.

The invention has been described above with reference to a few embodiment examples. It is obvious to a person skilled in the art that the invention is not exclusively limited to the embodiments described above, but that many other embodiments are possible within the scope of the inventive concept defined in the claims.

The invention claimed is:

1. Power control apparatus for supplying power between an energy source and the motor of a transport system, said power control apparatus comprising a power supply circuit which comprises at least one electronic power converter containing controllable change-over switches, said power control apparatus further comprising at least a first and a second controller adapted to communicate with each other, said controllers comprising altogether at least one converter control function, and said power control apparatus comprising the control of at least one braking device, where at least the first and the second controllers comprise inputs for motion signals of the transporting equipment, monitoring of the motion of the transporting equipment, and outputs for control signals for at least one braking device.

2. Power control apparatus according to claim 1, where at least the first controller includes a converter control and at least the second controller includes an adjusting unit for making adjustment of transporting equipment velocity, and where the first and the second controllers are configured with inputs for measurement signals indicating the velocity and/or position of the transporting equipment and that said controllers are configured to monitor of the velocity and/or position of the transporting equipment.

3. Power control apparatus according to claim 1 or 2, where the first and the second controllers include safety diagnostics.

4. Power control apparatus according to claim 3, where an error situation in the safety diagnostics is determined on the basis of transporting equipment motion monitoring.

5. Power control apparatus according to claim 3, where an error situation in the safety diagnostics is determined on the basis of communication between the first controller and the second controller.

6. Power control apparatus according to claim 1, where a communication bus is provided between the first and the second controllers, the second controller is adapted to send to the first controller a message at predetermined time intervals, the first controller is adapted to send a reply message to the second controller within a predetermined period of time upon receiving the message, and both controllers are adapted to perform independently of each other an action to stop the transport system upon detecting that the intervals between messages or reply messages deviate from predetermined limit values.

7. Power control apparatus according to claim 2, where both the message and the reply message contain at least the following data items:

velocity and/or position measurement data read by the controller sending the message or reply message notification regarding a fault detected by the controller sending the message or reply message a control command to at least one braking device and that both controllers are adapted to perform an action independently of each other to stop the transport system upon detecting a deviation between the braking-device control commands or between the velocity and/or position measurement data of the controllers, or upon receiving a message regarding a fault detected.

8. Power control apparatus according to claim 1, where the power control apparatus includes a power interrupter for interruption of the power supply circuit, and that at least the first and the second controllers are configured with an output for a control signal for interrupting the power supply circuit.

9. Power control apparatus according to claim 4, where the power control apparatus comprises a controller for controlling the change-over switches of the converter, said controller comprising a power source at least for control energy controlling the positive or negative change-over contacts, the power interrupter of the power supply circuit comprises two controllable switches fitted in series with the power source for interrupting the supply of control energy, and that the first controller is adapted to control the first switch and the second controller is adapted to control the second switch for interrupting the supply of control energy.

10. Power control apparatus according to claim 1, where control of at least one braking device comprises two switches fitted in series in a brake control circuit, the first controller comprises an output for the control signal of the first switch and the second controller comprises an output for the control signal of the second switch, and that both the first and the second controllers comprise inputs for data indicating the positions of the first and the second switches.

11. Power control apparatus according to claim 1, where the first controller comprises an output for a first pulse-shaped control signal, the second controller comprises an output for a second pulse-shaped control signal, the first controller comprises an input for the measurement of the second pulse-shaped control signal, and the second controller comprises an input for the measurement of the first pulse-shaped control signal, control of at least one braking device comprises an input for the first and second pulse-shaped control signals, and where the control of the said braking device is adapted to supply control power to the braking device only via simultaneous control by the first and the second pulse-shaped control signals.

12. Power control apparatus according to claim 1, where the power control apparatus comprises a data transfer bus comprising a first data bus, over which the first controller is adapted to communicate, and a second data bus, over which the second controller is adapted to communicate, a transmitter connected to the first data bus for transmitting a first motion signal of the transporting equipment and a transmitter connected to the second data bus for transmitting a second motion signal of the transporting equipment, and where the first and the second controllers are adapted to compare the first and the second motion signals read by them parallelly from the data buses and, upon detecting the signals to differ from each other by more than a certain limit value, to perform an action to stop the transport system.

13. Power control apparatus according to claim 8, where the data transfer bus comprises a transmitter connected to the first data bus for the transmission of status data of a safety contact of the transport system and a transmitter connected to the second data bus for the transmission of status data of a safety contact of the transport system.

14. Power control apparatus according to claim 1, where the converter control comprises a motor driving mode and that at least the first controller is adapted to switch alternatively the positive or the negative change-over contacts of the converter to a conducting state for dynamic braking of the motor in a situation where the state of the converter control differs from the motor driving mode.

15. Power control apparatus according to claim 1, where the monitoring of the velocity and/or position of the transporting equipment comprises in connection with the first controller an envelope curve of a first maximum allowed velocity and in connection with the second controller an envelope curve of a second maximum allowed velocity, and where the first and the second controllers are adapted to compare the measured velocity with the value of the corresponding envelope curve of the maximum allowed velocity and, upon detecting a difference exceeding a predetermined limit value between the measured velocity and the envelope curve value, to perform an action to stop the transport system.

16. Power control apparatus according to claim 11, where the second controller, upon detecting a difference exceeding a predetermined limit value between the measured velocity and the value of the envelope curve of the maximum allowed velocity, is adapted to send to the first controller a motor-torque set value to stop the transport system with predetermined deceleration.

17. Power control apparatus according to claim 11 or 12, where the first controller is adapted, upon detecting a difference exceeding a predetermined limit value between the measured velocity and the value of the envelope curve of the maximum allowed velocity, to stop the motor by converter control with predetermined deceleration.

18. Power control apparatus according to claim 1, where the first controller comprises mains converter control.

19. Power control apparatus according to claim 14, where at least the first controller is adapted, upon detecting a failure situation, to interrupt via mains converter control the supply of power from the energy source to the direct-voltage intermediate circuit of the power supply circuit.

20. Power control apparatus according to claim 1, where the said power control apparatus is adapted to supply power between an energy source and the motor of an elevator system.

* * * * *

UNITED STATES PATENT AND TRADEMARK OFFICE

CERTIFICATE OF CORRECTION

PATENT NO. : 8,096,387 B2
APPLICATION NO. : 12/572800
DATED : January 17, 2012
INVENTOR(S) : Ari Kattainen et al.

It is certified that error appears in the above-identified patent and that said Letters Patent is hereby corrected as shown below:

ON THE TITLE PAGE:

Insert the following Foreign Application Priority Data:

-- (30) Foreign Application Priority Data

April 3, 2007 (FI) ..... 20070260 --.

Signed and Sealed this
Seventeenth Day of April, 2012

David J. Kappos

David J. Kappos
*Director of the United States Patent and Trademark Office*